US005680678A

United States Patent [19]

Nauthe et al.

[11] Patent Number: 5,680,678

[45] Date of Patent: Oct. 28, 1997

[54] PROCESS AND GUIDE SYSTEM FOR THE INTRODUCTION OF A FIBER SLIVER INTO THE NIP LINE OF CALENDER DISKS OF A FIBER PROCESSING TEXTILE MACHINE

[75] Inventors: Alfred Nauthe, Böhmfeld; Wolfgang Göhler, Lenting, both of Germany

[73] Assignee: Rieter Ingolstadt Spinnereimaschinenbau AG, Ingolstadt, Germany

[21] Appl. No.: 622,213

[22] Filed: Mar. 27, 1996

[30] Foreign Application Priority Data

| | | | |
|---|---|---|---|
| Apr. 7, 1995 | [DE] | Germany | 295 06 107 U |
| Jul. 24, 1995 | [DE] | Germany | 295 11 919 U |
| Sep. 22, 1995 | [DE] | Germany | 195 35 297.1 |
| Sep. 22, 1995 | [EP] | European Pat. Off. | 95114975 |

[51] Int. Cl.[6] ..... D01H 5/72; D01H 13/04; D01G 15/46

[52] U.S. Cl. ..... 19/157; 19/150

[58] Field of Search ..... 19/150, 157

[56] References Cited

U.S. PATENT DOCUMENTS

| | | | |
|---|---|---|---|
| 614,819 | 11/1898 | Albasini | 19/150 X |
| 2,996,873 | 8/1961 | Armstrong | 19/157 X |
| 4,372,010 | 2/1983 | Gauvain . | |
| 4,575,903 | 3/1986 | Gauvain . | |
| 4,763,387 | 8/1988 | Bothner . | |
| 4,922,580 | 5/1990 | Bothner et al. . | |
| 4,949,431 | 8/1990 | Gasser . | |
| 5,016,322 | 5/1991 | Erni et al. | 19/150 |
| 5,412,846 | 5/1995 | Hauner . | |

FOREIGN PATENT DOCUMENTS

| | | | |
|---|---|---|---|
| 801254 | 11/1950 | Germany . | |
| 2623400 | 3/1977 | Germany . | |
| 290679 | 6/1991 | Germany . | |
| 406508 | 3/1934 | United Kingdom | 19/157 |
| 632266 | 11/1949 | United Kingdom . | |
| 786528 | 11/1957 | United Kingdom . | |

*Primary Examiner*—John J. Calvert
*Attorney, Agent, or Firm*—Dority & Manning

[57] ABSTRACT

A fiber sliver guidance system for a textile machine drafting equipment is provided and includes a first nozzle section disposed relative to the delivery rollers to receive a fiber fleece therefrom and form the fiber fleece into a fiber sliver. A second nozzle section is connected to the first nozzle section to receive the fiber sliver therefrom. The second nozzle section includes an essentially cylindrical sliver channel disposed to guide the sliver to the nip of the calender rollers. The sliver channel of the second nozzle section includes a guiding section defined by spaced apart end segments which extend on opposite sides of an alongside the calender rollers past the nip. The side signals cooperate with the calender rollers to define a limited air loss channel for the fiber sliver directly to the nip.

13 Claims, 8 Drawing Sheets

$\alpha_A \approx 20° - 50°$ $\alpha_B \approx 1° - 10°$ $\alpha_B \approx 1° - 10°$ $\alpha_A \approx 20° - 50°$

PROCESS AND GUIDE SYSTEM FOR THE INTRODUCTION OF A FIBER SLIVER INTO THE NIP LINE OF CALENDER DISKS OF A FIBER PROCESSING TEXTILE MACHINE

BACKGROUND OF THE INVENTION

The present invention relates to the field of textile machines, and particularly to a draw frame with a calender system consisting usually of two calender disks facing each other (or calender roller pair) by means of which a fiber sliver is compressed. The invention relates to a guide system with guide nozzles for the introduction of the fiber sliver between the calender disks. The invention also relates to the wear or replacement parts of the guide system which are subject to greater wear in operation. The invention proposes a process making it possible to accelerate and at the same time simplify the preparation or introduction of the drafted fiber sliver between the calender disks.

According to the state of the art, it is known that the output of the drafting equipment of a draw frame (e.g. of a fiber processing machine) is constituted by a pair of delivery rollers. Immediately following the delivery rollers the fiber sliver is spread out in accordance with the roller width. The person schooled in the art designates the fiber sliver spread out at this location as a fiber fleece. The fiber fleece, i.e. the spread-out fiber sliver, is conveyed into the opening of a fleece funnel. The fiber fleece is collected in the fleece funnel and in the outlet of the fleece funnel it is again formed into a fiber sliver. The fiber sliver is conveyed through the funnel outlet of the fleece funnel to a fiber sliver channel which is of considerable length. At the end of the fiber sliver channel the fiber sliver is introduced into a fiber sliver funnel (also called a sliver funnel) which deflects the conveying direction of the fiber sliver by approximately 90° and is introduced between a pair of calender rollers (also called a pair of calender disks). After passing through the pair of calender rollers the fiber sliver, which was compressed by the calender rollers, is conveyed to the depositing device of the draw frame. Such an example is shown in the left half of FIG. 1, whereby the fiber sliver channel is given reference number 8 and the delivery rollers of the draw frame is given reference numbers 70*a* and 70*b*. A setup with a long fiber sliver channel 8 is also described in EP 593 884 A1. Another example of a long fiber sliver channel (also designated by reference number 8 therein) is U.S. Pat. No. 4,372,010. The pair of calender rollers bears references 9*a*, 9*b* therein. Another example for the common use of the long fiber sliver pipe is shown in DE-A 26 23 400. Therein the fiber sliver pipe itself is bent at an angle of approximately 90° and guides the fiber sliver without change in angle between the calender disks which are designated therein by 5, 6. An oval shape of the channel bearing reference number 14 therein is described as being advantageous (see also page 9, last paragraph therein).

Finally, DE 290 697 also shows a collection channel. In this case the fleece funnel and sliver funnel are clearly at a distance from each other. A ventilation opening (8) clearly allows the air flowing in at the beginning of the collection channel (5) to escape completely before the narrowest point of the sliver funnel.

DE-PS 36 12 133 relates to a sliver introduction channel between output rollers of the drawing equipment and downstream sliver funnel on a spinning plant preparation machine. The sliver guiding channel relates to the automatic introduction of the sliver beginning into the sliver funnel (column 1, lines 9–10). The sliver guiding channel is relatively long and is given the large diameter which is usual in the state of the art, without any change in cross-section. The sliver guiding channel imparts the necessary guidance to the fiber sliver on its way to the sliver funnel. Along this route, several injectors (air channel, compressed-air channel) are installed. The total sliver mass of the sliver beginning is pulled by means of an injector into the sliver guiding channel. The total sliver mass of the sliver beginning must then be compressed exclusively in the sliver funnel (column 1, lines 54–58).

The problem of air back-up in the sliver funnel (column 1, lines 59–62) exists. In order to eliminate this problem, the sliver funnel must have a device for rapid enlargement of its cross-section. This is a pre-condition for the automatic introduction of the fiber sliver.

It is a further disadvantage of the state of the art that the calender disks must be, in addition, opened for automatic introduction of the sliver beginning. The sliver beginning cannot be pulled into the nip of the calender disks when they are closed and when they are rotating into their nip. The state of the art mentions calender rollers or calender disks in the past. A calender disks has simply a smaller width than a calender roller. This has however no effect upon the function of the invention described herein, so that for the sake of simplification, only calender disks or a pair of calender disks shall be mentioned hereinafter.

OBJECTS AND SUMMARY OF THE INVENTION

The invention departs from the conventional configuration and has as a principal object to create an automatic transportation of the fiber sliver from the fleece funnel to the nip of the calender disks in a compact design, while at the same time simplifying fiber guidance. Additional objects and advantages of the invention will be set forth in the following description, or may be obvious from the description, or may be learned through practice of the invention.

According to the invention, the long fiber sliver channel is omitted and the fleece funnel (as a first nozzle section) and the sliver funnel (as a second nozzle section) are installed directly one after the other, while being interlocked in such a manner that they can either be tilted against each other or so that their angle position can be changed (tilted) jointly relative to another nozzle section. Tilting the axis of the first nozzle and of the second nozzle makes it possible to change the route of the fiber sliver which goes one time through the above-mentioned nozzle insert and another time not through the nozzle insert, this being the so-called pre-work or preparation position.

The fiber sliver guiding device may be made in one part or in several parts, whereby its insert is smaller and is inserted into the nozzle as a replaceable wear part. The wear parts are designated as being internal inserts. The calender guiding nozzle, which reaches over the pair of calender disks in the area of the nip, constitutes one side of the swivel bearing of the nozzle section located above, or of its internal inserts.

By omitting the fiber sliver channel, the fiber guiding system according to the invention becomes especially short and compact, and at the same time long distances, and thereby undesirable technological dead-times, can be reduced. Despite its compact construction, the fiber sliver guidance device is easy to handle and even allows for two positions of the interlocked nozzle sections, one for normal operation and one for preparation. Surprisingly, the compact fiber sliver guidance system is then particularly easy in maintenance, easy to adjust, and is more user-friendly in its adjustment effort than the long fiber sliver guidance systems known in the state of the art.

Easy and rapid replacement of the sections of fiber guidance system subjected to wear is possible with the internal inserts. Adjustment tasks in assembly, as well as for replacement work, are eliminated to a great extent due to the plug-in system of the individual sections. Work is concentrated on a narrow area between the output of the delivery rollers and the pair of calender disks and can be managed easily. To start maintenance work, only the fiber sliver channel above the calender disks need be swivelled around an axis which lies in the fiber sliver channel and is aligned at a right angle to same.

The new design also makes it possible to accelerate and simplify the introduction of the fiber fleece which has not yet been drafted and to convey with the calender guiding nozzle to behind the nip, in part with air flow (up to the nip) and in part with rotational impulse of the closed calender rollers (through the nip). If the calender disks are spread apart (open nip), the air stream alone suffices for complete introduction of the fiber sliver between the calender disks. The beaks of the guiding nozzle near the calender are provided with axially traversing (slight) widening areas extending in the radial direction which guide air past the nip. The beaks (beak halves) have a length and a width (L, W) coordinated with the widening so that practically the greater portion of the guiding air, or all of it, is introduced into the widening and is sealed off without contact in transversal (radial) direction to a considerable extent.

The beaks can be made in one part with the body of the nozzle through a cone but their distance need not be adjustable, nor their alignment relative to the body part of the sliver funnel holder.

If the width of the calender disks is changed, a suitable sliver funnel holder is selected into which the same sliver funnel can be inserted. Adjustment and adaptation tasks are eliminated through modular adaptation.

The invention's proposal of omitting the long fiber sliver channel causes the calender guiding nozzle to be moved close to the fleece funnel and constitutes the fixed part of the nozzle insert relative to which the fleece funnel axis can be tilted.

The individual nozzle sections of the fiber sliver guiding device are all placed close together. The central axis of each section constitutes the axis of the fiber sliver channel whereby each section may be one of several inserts. The design with several inserts has the advantage that despite compact construction, only those element of the overall fiber sliver guiding system need be replaced which are subject to greater wear. Thus two internal inserts are provided: One of them is an internal insert of the fleece funnel located right after the delivery rollers of the drafting equipment; the other internal insert is the one constituting the sliver funnel at which the greatest diameter change of the fiber sliver channel occurs. The replaceability is also ensured when batches are changed.

The possibility of swivelling one axial section relative to the other axial section can be realized by the internal insert having a rounded articulation surface on its forward end which is seated in a convex bearing surface provided on the other internal insert. The rounded articulation surface and the convex bearing surface together constitute a guide channel which is air tight in the radial direction when the first internal insert sits on top of the second internal insert and is swivelled into operating position. However, swivelling is possible, whereby the sealing effect is ensured in the radial direction in both swivel positions.

The essentially loss-free air transport through the two internal inserts results in good air maintenance and little loss with respect to an automated introduction of fiber sliver between the calender disks. The lateral flow openings which are provided for this and are provided in the .second internal insert are preferably non-swivelling and thus in fixed position. The injector in this embodiment is located on the sliver funnel and the fiber sliver channel above the injector can be swivelled above the rounded articulation surface. The guiding system has no additional channels for the entry of air flow above the sliver funnel.

In addition to its suction effect, the injector is able to impart a twist on the guided fiber sliver. This is achieved if two injector bores let out parallel offset relative to each other in a plane of the channel of the sliver funnel.

An alternative fiber sliver guiding system is obtained if the nozzle section constituting the sliver funnel is itself capable of being swivelled and if the injector channels provided in it swivel together with it. The position of only one guidance section remains swivelled without change relative to this guidance section in the immediate proximity of the calender disks and of the nip (calender guiding section), and the remainder of the fiber sliver channel extending to within close proximity of the delivery rollers swivels relative to this guiding section. The above-mentioned rounded articulation surface is then located at the forward end of the sliver funnel and the convex bearing surface on the fixed calender guiding section. Here too, the coupling is air-tight in radial direction in operating position, so that good air management and few losses are achieved in spite of the ability to swivel and the modular construction of the fiber sliver channel (corresponding to a guiding channel).

The low losses in air management are maintained also beyond the calender nip if the calender guiding nozzle which is a replacement and exchange part is bilaterally open in its beak section, so that the calender disks are able to enter the beaks in part from the side. The air stream guided over the articulation surface can thus be conveyed up to the nip and even beyond the nip and past the calender disks, so that the fiber sliver to be introduced can be guided up to the nip and beyond it. Guidance with the two partially round beaks of the calender guidance nozzle is obtained here independently of whether the calender disks are spread apart (so that they produce an open nip) or are pushed together (so that the nip has practically no passage opening.)

At the input of the fiber sliver guiding system, an additional deflection roller which clearly changes the direction of travel of the fiber fleece FV is provided. The clear change is in the direction of the bent nozzle axis of the fiber sliver guiding system so that the first nozzle (the fleece funnel) of the guidance system is able to receive the drafted fiber sliver and to bring it together. An angle of approximately 60° is preferred by which the deflection roller changes the path FV of the fleece. The axis of this additional deflection roller is located in the plane defined by the swivel axis V and the nip.

The first nozzle has a funnel area as well as a ramp or plateau area, so that the fiber sliver is able to achieve the rolling up, deflection and gathering of the fiber sleeve when this nozzle is in its operating position and so that when the first nozzle is tilted, the ramp area ensures that the fleece conveyed to it is deflected so that it is conveyed out of the area without blocking the area of the drafting equipment and can be removed easily by the operator.

The ramp area also ensures that no back-up of the fiber fleece can form because the first nozzle is swivelled automatically under the force of the fleece conveyed to it and the ramp area deflects the fleece which continues to be fed out of the interior of the drafting equipment until the delivery rollers are switched off. The first nozzle has at the same time assumed its preparation position, i.e. the position which it assumes when back-up occurs.

The swivelling first nozzle can be supported in the sliver funnel nozzle (the cylindrical-funnel-shaped nozzle) so as to be capable of swivelling; the first nozzle can however also be supported on the above-mentioned calender guiding section together with a nozzle section following it immediately and made in the form of a sliver funnel and be capable of swivelling.

The nearly totally loss-free movement of air from the fleece funnel to the nip of the calender disks is characteristic for the process of air-assisted introduction of the spread-out fiber sliver (fiber fleece) into the fiber sliver guiding channel of the textile machine. The nearly loss-free movement of air is subdivided into a completely loss-free segment and a second segment in which no considerable losses occur.

a) The air flow from the fleece funnel (which rolls up the drafted, spread-out fiber sliver (fiber fleece) and gathers it together) to the sliver funnel (which causes the compression before the pair of calender disks) is guided without losses. In this area no lateral opening through which air could escape is made in the guiding channel. Only lateral inflow bores exist in this area, producing and maintaining the suction air stream.

b) In the area following the sliver funnel, the air stream is screened from lateral beaks to such an extent that it is guided past the calender disks and its suction effect can be maintained for the fiber sliver up to the nip. Since the calender disks rotate in operation and since a rotation impulse is used also when the fiber sliver (or part of the fiber sliver) is introduced in order to transport the fiber sliver which is conveyed to the nip, by air suction entirely through the nip while being compressed at the same time, the insides of the beaks are separated by a small distance from the lateral surfaces of the calender disks. The calender disks are thus able to rotate without friction because the mechanical screening used for air guidance does not come into contact with them. At the same time, it is ensured that the clearance which remains between the areas of the screening directly next to the sides of the calender disks is as small as possible so that practically no air escapes. Only at the front end of the screening does this air escape. This point lies behind the (open or closed) nip (as seen from the direction of fiber sliver conveying).

Due to the mostly closed air guidance, the process for automatic introduction of the beginning of the spread-out fiber sliver (fiber fleece) is very economic from the point of view of air management. At the same time, the process is unaffected by fluctuations in the compressed air and can operate reliably with a wide range of pressures of the compressed air which becomes a suction flow formed above as it is brought in at an angle relative to the fiber sliver channel direction.

No mechanical threading of a section of fiber fleece into the fleece funnel takes place. The fiber fleece need merely be brought to a narrow width at its forward end (to width F1) and the remaining, narrower section must be shortened to a predetermined length (length H) which depends on the weight of the sliver and the length of the fiber sliver channel from the fleece funnel to the nip. Switching on controls for the feeding of compressed air in order to produce a brief compressed-air impulse causes the threading of the narrowed section up to the nip, where enabling a brief rotational impulse of the calender disk realizes the complete threading or the complete introduction of the fiber sliver between the calendar disks.

The compressed-air impulse can be coupled advantageously to a rotational impulse of the calender disks that is slightly offset in time, so that the operator requires only one push button to thread the fiber sliver.

A fiber sliver cannot be presented, introduced and placed in operating position in any simpler, more rapid and reliable manner.

The suction air stream above the location of entry of compressed air is constituted reliably if the compressed air is introduced at the point of the fiber sliver channel which has the smallest diameter. As a rule, this is the sliver funnel which is located close to the calender rollers. A stream of compressed air fed here in the direction of the calender rollers produces a reliable suction stream above the feed point and up to the fleece funnel, as no air losses occur there.

In the entire section from the fleece funnel to the sliver funnel, no openings at a right angle to the fiber sliver channel are provided which could allow air to escape. The reliable build-up of the suction air stream starting at the forward end of the conveying path and acting back to the point of entry of the fiber sliver—the fleece funnel—makes it possible to dispense with any additional inflow of air in this area, such as is usually the case in the state of the art when compressed-air inflow points are provided at the fleece funnel or shortly thereafter, while venting is provided on the sliver funnel or shortly before it.

According to this invention, the fiber sliver is thus seized at its forward end by the air stream, is pulled along the entire fiber sliver channel and is presented directly to the calender disks. The fiber sliver is not "pushed" by compressed air and vented far from the calender disks.

DETAILED DESCRIPTION OF THE PREFERRED EMBODIMENTS

Figure 1:
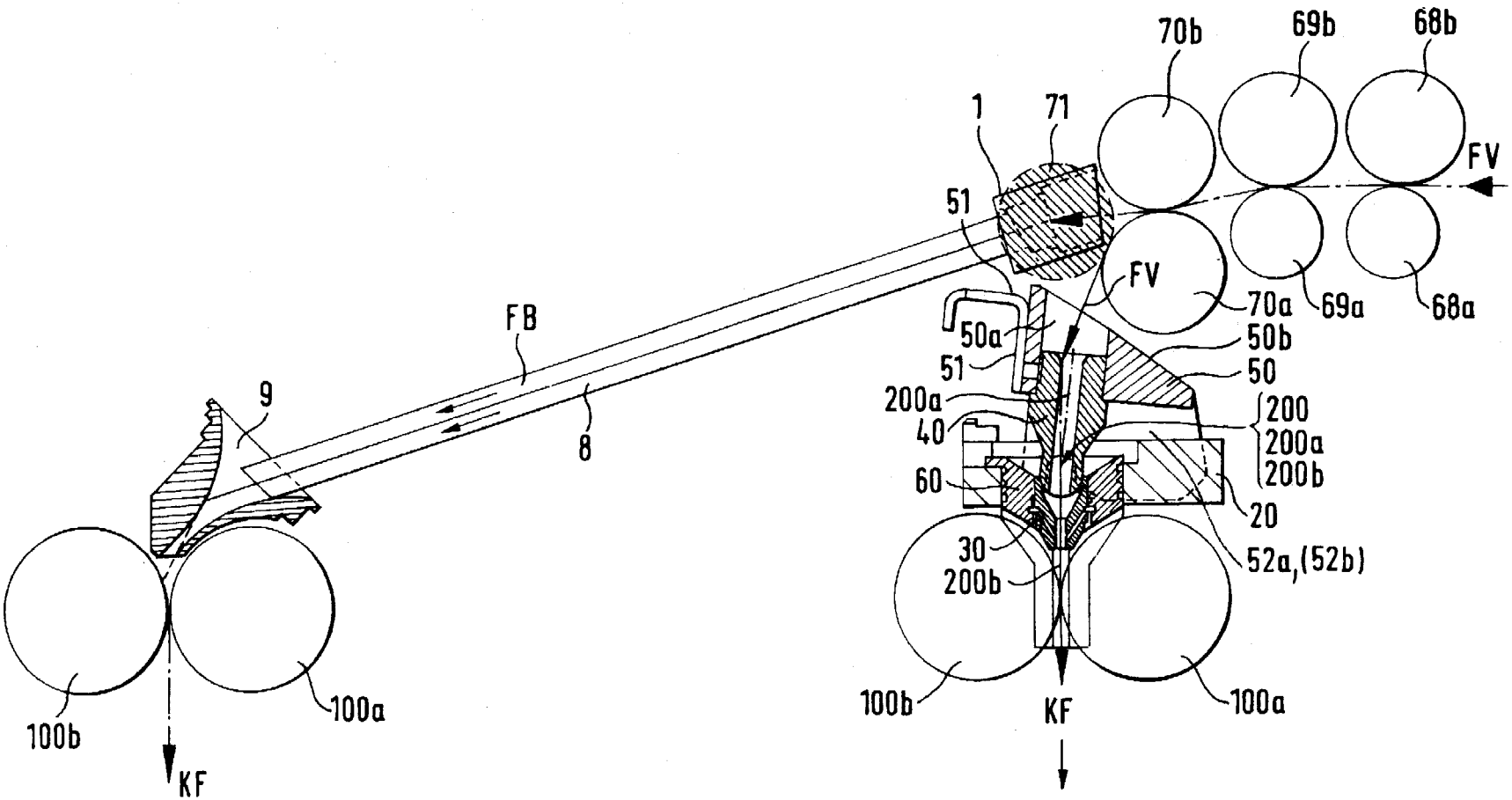
FIG. 1 shows the superposition of a conventional configuration of a fiber sliver guidance system with a long fiber sliver channel and an example of a compact design with interlocked nozzle inserts 30, 40, 50, 60 of which two nozzle inserts 40, 50 are able to tilt relative to the other two nozzle inserts 30, 60 which are installed on a fixed nozzle holder 20 located above the calendar disks 100*a*, 100*b*. The superimposed drawing serves to show the shortening of the conveying path.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present invention cover such modifications and variations.

Figure 2B:
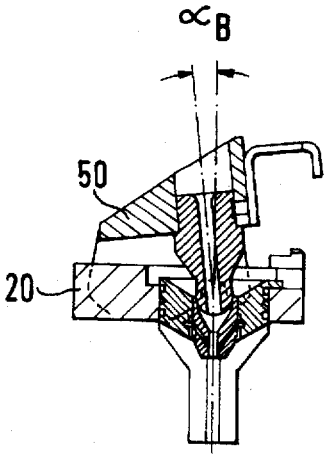
FIGS. 2*a* and 2*b* show the two swiveling positions $\alpha_A$, $\alpha_B$ of the interlocked nozzles of the overall nozzle insert as an example of an embodiment of the invention.
Figure 2A:
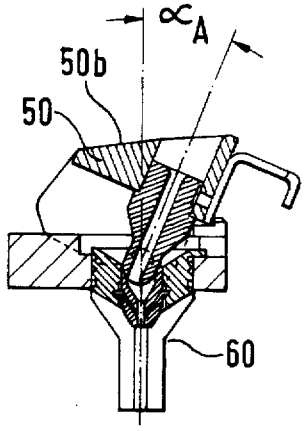
Figure 2:
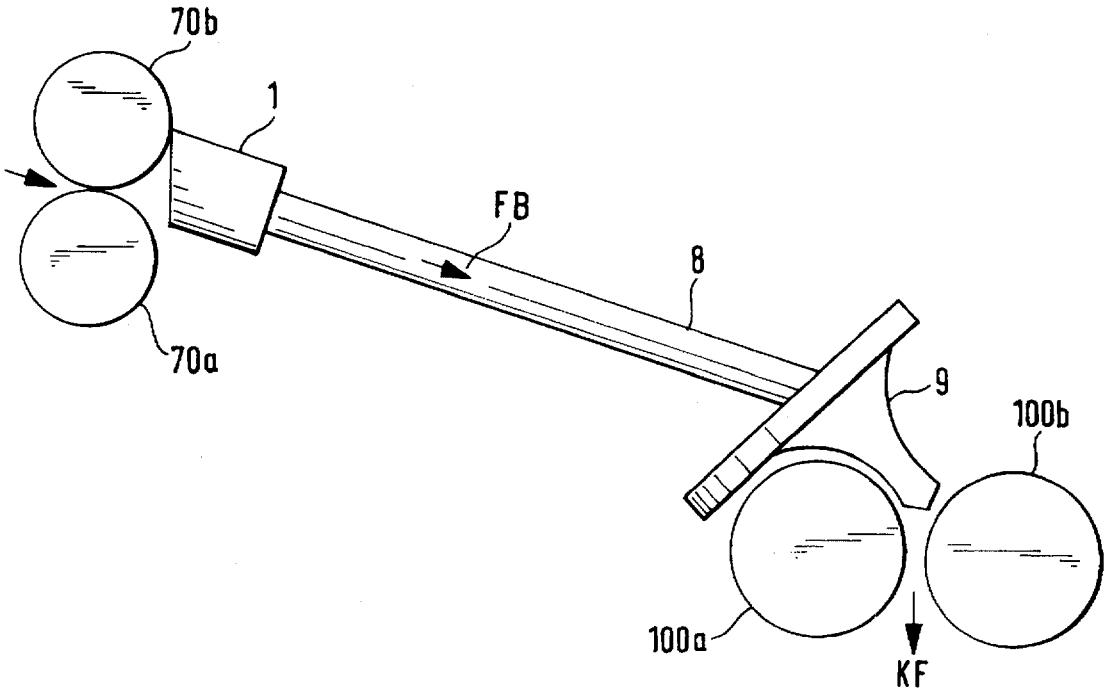
FIG. 2 explains the fiber sliver guiding system of the state of the art—taken form EP 593 884—with a long fiber sliver channel 8, sliver funnel 9 and calender disks 100*a*, 100*b*. The fleece funnel is designated by 1 and the output rollers of the draw frame by 70*a*, 70*b*.

The superposition shown in FIG. 1 clarifies the difference with the state of the art which is shown schematically in FIG. 2. The fiber sliver FV, which is not yet properly drafted as it is introduced, is introduced in the state of the art via drafting rollers 68a, 68b, 69a, 69b and delivery rollers 70a, 70b into a long guiding channel 8 which lets out into a sliver funnel 9. The funnel channel 9 deflects the fiber sliver FB by about 90° into the nip of the calender with its calendar disks 100a, 100b. The calendered fiber sliver KF emerges vertically downward from the calender and is fed into a depositing device (not shown). This fiber sliver guide is also shown in FIG. 2 with the same reference numbers.

An embodiment of the invention given as an example shortens the path of the fiber sliver and omits the fiber sliver channel 8. An additional deflection roller 71 causing a deflection of approximately 60° in the direction of fleece conveying FV, and which introduces the fiber sliver into one of several functional elements constituting the fiber sliver channel (guiding channel), is added.

The first element is the fleece funnel 50 (also called nozzle). The fleece funnel is a nozzle with an essentially rectangular opening. The fleece funnel has a ramp surface 50b and a funnel section 50a following it immediately in which the fiber sliver (fiber fleece) arrives in a wide form and is rolled, folded over and introduced into a first channel segment. The channel segment is constituted by a insert 40 which is inserted on the back of the funnel section 50a of the fleece funnel 50 and is attached with a screw. It can be adjusted.

The fleece funnel 50 (with internal insert) can be tilted by means of a handle segment 51 in such manner that the ramp surface 50b can be swivelled in the direction of travel of the fiber fleece (i.e. conveying direction) and the funnel section 50a can be swivelled next to it.

An articulation surface 41a, 41b is provided at the forward end of the insert 40 and in the angle position $\alpha_B$ shown in FIG. 1 or FIG. 2b it seals off the guiding channel from the downstream sliver funnel 30.

Figure 4A:
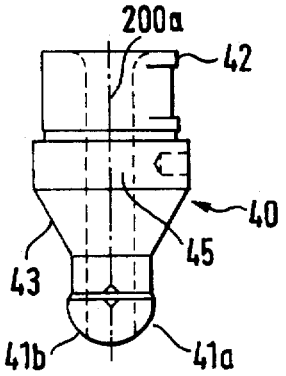
FIGS. 4*a* and 4*b* show the internal insert 40 of the fleece funnel 50.
Figure 4B:
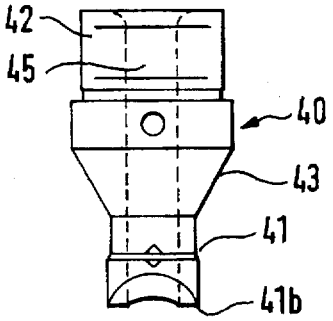

The articulation surface of the forward, cylindrical segment of the internal insert 40, which is symmetrical with the central plane of the first insert 40, consists of two surface segments 41a, 41b which narrow towards the back (in axial direction) and are constantly curved. These surface segments 41a, 41b engage a corresponding bearing surface 35on the sliver funnel 30. FIGS. 4a and 4b show this articulation surface in two views at the forward end of insert 40 of the fleece funnel 50. Swivelling the fleece funnel 50 in the direction α in the other angular position $\alpha_A$ does not open the radial air-tight closure between fleece funnel and sliver funnel. In the closed ($\alpha_B$) as well as in the open ($\alpha_A$) state, a radial air-tight fiber sliver conveying is achieved.

The radial tightness of the articulation surface 41a, 41b at the bearing surface 35 can be adjusted. The upper part (above the articulation surface) can be displaced for this in axial direction, in particular in radial direction, relative to the lower part. The fixed holder 20 in which the sliver funnel 30 is inserted constitutes the basis for the adjustment.

If the fleece funnel 50 is made in two parts, with an insert 40 inserted in it against the conveying direction of the fiber sliver, the previously mentioned relative adjustment can be carried out using a handle 51.

The fiber sliver is conveyed through the fleece funnel 50, the internal insert 40, and the sliver funnel 30 into the guiding channel and up to the nip 100c, and for this the fleece funnel 50 is swivelled out. The fiber fleece part F1, which was manually narrowed according to FIG. 3 and is held into the funnel outlet 50a, is sucked in via injection bores 34a, 34b, 64a, 64b on the sliver funnel. A brief suction flow lasting 500 milliseconds suffices in order to convey the narrowed fiber fleece segment F1 until it is in front of the nip 100c, since the articulation surface 35 and the bearing surfaces 41a, 41b of the internal insert 40 are radially air-tight. No mechanical means to assist insertion are needed.

In order to convey the segment F1 of the fiber fleece, and with it the full width F of the fiber fleece through the nip, a brief rotational impulse of duration $T_2$ is given the calendar disks. After a predetermined suction period $T_1$, the brief suction flow is able to switch itself off. It can be superimposed on the duration $T_2$ or can be initiated separately and manually.

Figure 5A:
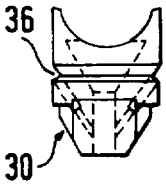
FIGS. 5*a*, 5*b* and 5*c* and 5*d* show the sliver funnel 30 for insertion into a holder 60 in accordance with FIG. 6*a*.
Figure 5B:
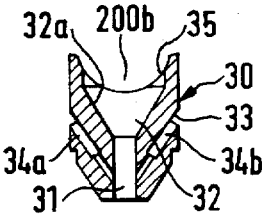
Figure 5C:
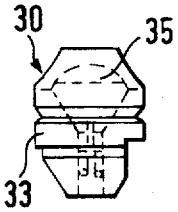

The form of the sliver funnel 30 is clearly shown in FIGS. 5a, 5b and 5c in which the direction and the placement of injection bores 34a, 34b, 64a, 64b in the sliver funnel are also shown in a larger scale. They let out into a cylindrical channel 31 which constitutes the forward end of the fiber sliver channel. The cylindrical section 31 widens over a conical segment 32a to reach the diameter of channel 32 which is predetermined by the internal insert 40. The bearing surface 35 is provided at the upper end of the cone 32a and follows the articulation surface 41a, 41b in its curve.

Figure 5D:
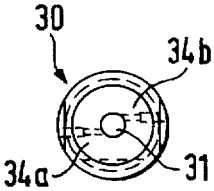

The slanted injection bores 34a, 34b can extend at an angle of approximately 45° relative to the axis 200b of the sliver funnel insert 30. They are advantageously parallel offset. This makes it possible to center the fiber sliver in the fiber sliver channel. Furthermore, the fiber sliver is given a twist therein. This imparts strength to the fiber sliver. The parallel offset injection bores 34*a*, 34*b* can be seen in FIG. 5*d*. They let out above a cylindrical section 33 of the insert 30 in a ring channel that is open to the outside.

Figure 6A:
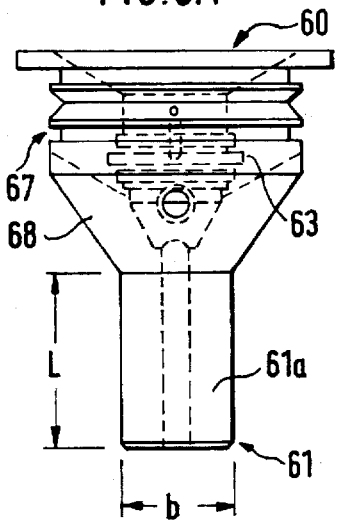
FIGS. 6*a*, 6*b* and 6*c* show the holder 60 in form of a beak funnel, of the sliver funnel 30.
Figure 6B:
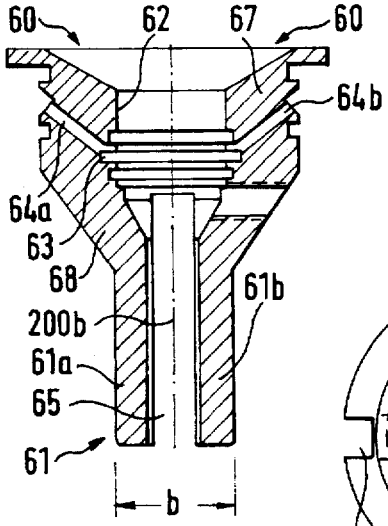
Figure 6C:
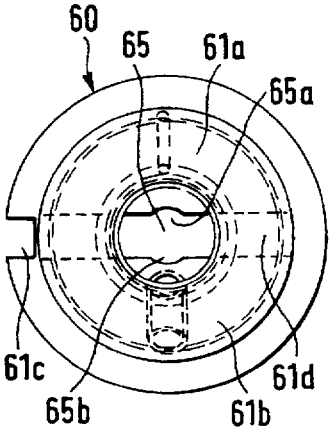

A sliver funnel holder 60 according to FIGS. 6*a*, 6*b*, 6*c* is provided with a central, approximately cylindrical opening 62 into which the sliver funnel insert 30 is inserted in its upper, approximately cylindrical section 67. A ring channel 63 which is open towards the inside extends in the cylindrical opening and can be fed compressed air by two or more cylindrical bores 64*a*, 64*b*. Starting from the ring channel, the compressed air introduced from the outside is introduced into the previously mentioned sloped injection bores 34*a*, 34*b* when the sliver channel insert 30 is inserted, to let out into the cylindrical segment 31 of the fiber sliver channel which is close to the nip 100*c*.

Figure 7:
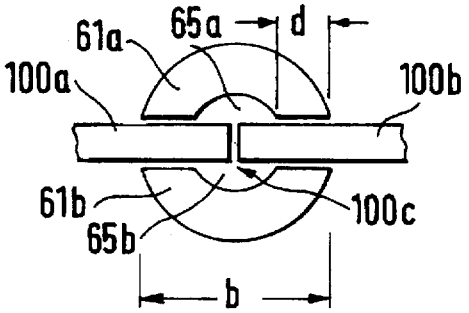
FIG. 7 shows a schematic top view of the nip 100c which is formed by the pair of calender disks 100a, 100b. The air channels 65a, 65b are delimited on the outside by the beaks 61, 61b which are installed on the sliver funnel holder 60 at the front. This view is shown in detail in FIG. 6c without calendar disks.
Figure 7A:
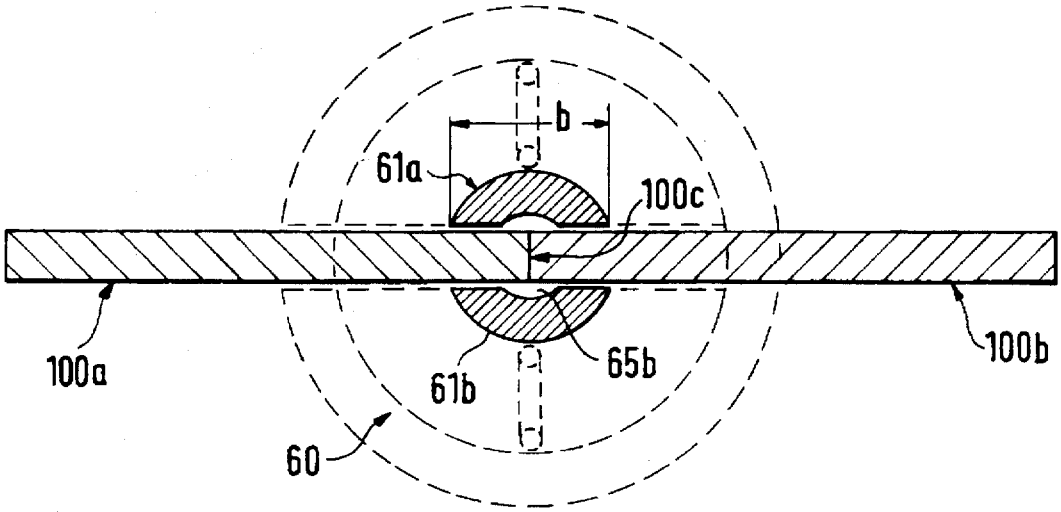
FIGS. 7a and 7b show a detail of the nip shown schematically in FIG. 7, once closed 100c, once open 100d, by switching off one calendar disk 100b relative to the other.
Figure 7B:
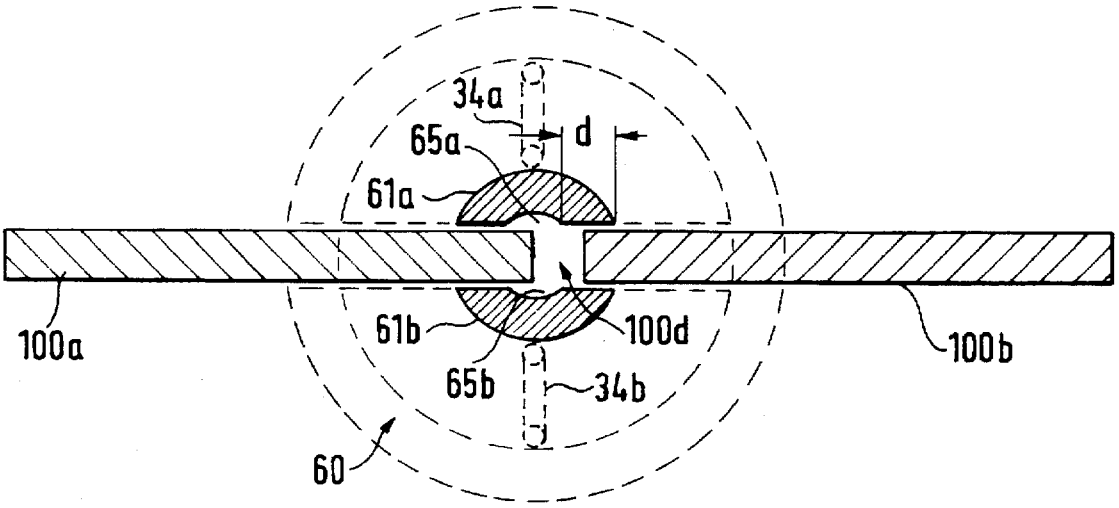

FIGS. 6*a* and 6*b* show the cylindrical beak 61 of the sliver funnel holder 60 which follows a conical section 68 constituting the transition between the upper cylindrical end 67 and the beak 61. It possesses a length L and a diameter which is shown as width b in the cross-section of FIG. 6*b*. The beak 61 is fixed and has two halves as it is split on the side, as shown in FIG. 6*c*. As shown in the schematic drawing of FIG. 7, a segment of the rotating calender disks 100*a*, 100*b* engage either of the two above-mentioned slits. This can also be seen clearly in FIG. 1, right half of the drawing. The nip is located in the center of the beak of the sliver funnel holder 60, i.e. in the axis 200*b* of the fiber sliver guide, and this nip can be closed (nip 100*c*) or can be opened by stopping one calender disk 100*b* (open nip 100*d*) as shown in FIGS. 7*a* and 7*b*.

The integrated beak halves 61*a*, 61*b* formed by the above-mentioned slits 61*c*, 61*d* in the cylindrical beak 61 guide the conveying air past the nip 100*c* or 100*d*. This conveying air was previously introduced via the injection bores 64*a*, 64*b* into the ring channel 63 and from there via the injection bores 34*a*, 34*b* of the sliver funnel 30 which form an angle with the axis 200*b* into the fiber sliver channel. The beaks make it possible to prevent the conveying air from escaping before the gap 100*c*, 100*d*, and instead it is conveyed beyond the gap to behind the nip. A first narrow channel section 65*a* on the one side of the calendar disks or a second narrow channel section 65*b* on the other side of the calendar disks, said channels having a nearly semi-circular cross-section, are used to convey this air. Either channel is very narrow as compared with the thickness d or width b of the beak 61 or its inner wall, which directly adjoins the lateral surface of the calendar disk.

Due to the lateral air conveying beyond the calendar gap by means of the beak halves 61*a*, 61*b* which have a length L equal to approximately one half the diameter of the calendar disks in the embodiment shown, the width b of the beak and of the covering d of the inside of the beak half have a sealing effect relative to the calendar disk. This sealing effect is constituted without contact by definite to considerable lateral flow resistance against the axial lateral air channels 65*a*, 65*b*.

Thus, only an almost exclusively axial air movement past the calendar nip is possible.

Only if the calendar nip 100*d* is open as shown in FIG. 7*b*, is the air conveyed not only past the calendar gap but clearly also through the calendar nip. The guiding air serves to thread the fiber sliver through the calendar nip and the calendar disk 100*b* can then be moved in so as to reach the operating position together with the threaded fiber sliver. In this case, where the calendar nip is open, the sealing surface (part of the covering d) is also large enough in View of the air resistance of the now enlarged passage channel consisting of the channel segments 65*a*, 65*b* and the open calendar nip 100*d* in order to prevent radial escape of the conveying air.

Figure 3:
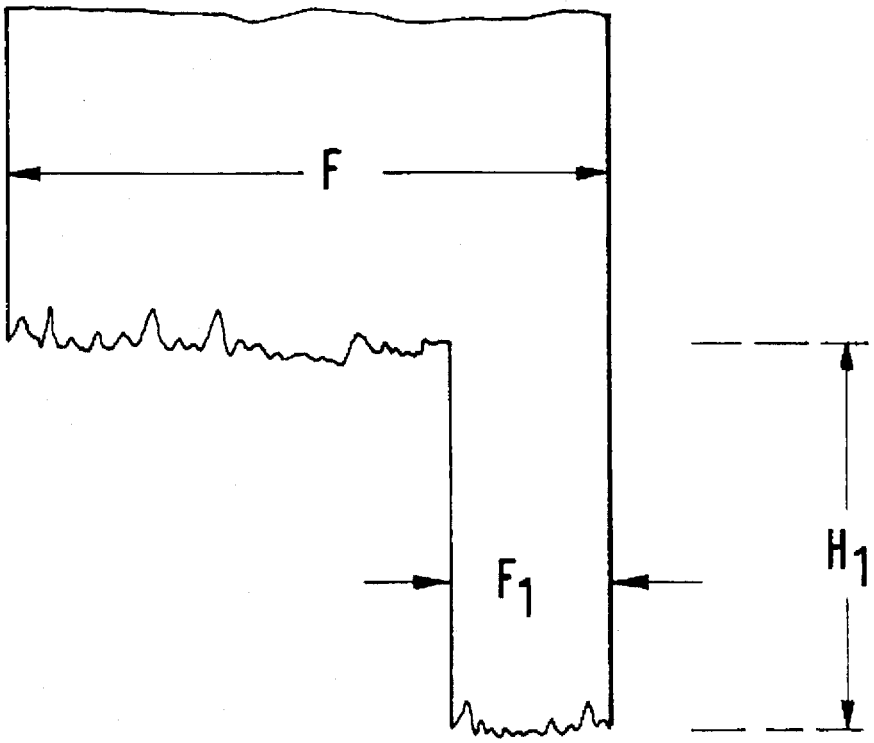
FIG. 3 shows the preparation of the fiber fleece F for introduction into the fleece funnel 50.

In the position of the calendar disks as shown in FIG. 7*a*, as well as in the position shown in FIG. 7*b*, the fiber sliver is presented in the same manner:

- The user swivels the fleece funnel (also called a nozzle) 50 by the grip 51 into preparation position which brings the ramp section 50*b* into the direction of fleece movement KF;
- A pre-run impulse of the rollers 86*a* to 70*b* and 71 of the drafting equipment conveys a short segment of fiber fleece on the ramp section 50*b* and out of conveying direction FV-FK;
- The user shortens the fiber fleece taken out and narrows it as per FIG. 3;
- The fleece funnel 50 being swivelled out, the user holds the narrow end F1 of the fiber fleece into the funnel opening 50*a* of the fleece funnel 50 and an air impulse is initiated via a push button or an automatic device at the narrowest location 31 of the fiber sliver guiding channel;
- The shortened and narrowed starting section is sucked into the fiber sliver channel by the almost loss-free air guidance—even if the fleece funnel 50 being swivelled out—and is taken up to the nip 100*c* (as per FIG. 7*a*) or even through the open nip 100*d* (FIG. 7*b*);
- The fleece funnel 50 is swivelled back into its operating position. A rotation impulse on the calendar disks 100*a*, 100*b*, if applicable with calendar disk 100*b* already moved in and/or on the delivery rollers of the drafting equipment 70*a*, 70*b*, conveys the fiber sliver reliably and without mechanical insertion assistance into the fiber sliver channel (guiding channel) with axis 200*a* (in the upper area) and 200*b* (in the lower area).
- Due to the air-tight conveying V in the fiber sliver channel, it is also possible to swivel the fleece funnel 50 back into the operating position shown in FIG. 1 only when the rotation impulse is terminated and the fiber fleece is already completely threaded.

The air pressure to be used may be 4 bar, adapted to a channel diameter 31 of approximately 3.8 mm in the sliver funnel 30 and approximately 8 mm in the channel 45 of the insert 40 of the fleece funnel 50. Tests have shown that a compressed-air impulse of only approximately 500 milliseconds (ms) duration suffices for reliable introduction of the forward portion F1 of the fiber fleece up to nip 100*c*. The length H1 of the manually narrowed fiber fleece is adapted here to the distance between the fleece funnel 50 and the nip 100*c* and thereby to the length of the air-tight fiber sliver channel.

The previously mentioned ring channel 63 directed inward can also be made in the form of a channel 36 directed outward on the insert 30, e.g. in form of a surrounding notch. The two channels 63, 36 can be provided so as to form a ring channel together when the funnel 30 and the holder 60 are plugged into each other.

The sliver funnel holder 60 has a truncated-cone clearance 68 between its upper cylindrical section 62 and its beak section 61. With it, and with the cylindrical section 68, it can be inserted into a support 20 which is placed close to and above the calendar disks 100*a*, 100*b* in such a manner that the beak section 61 of the holder 60 reaches over the calendar disks and the nip. Also held on the support 20 at a distance via bearing brackets 52*a*, 52*b*, is the fleece nozzle 50 which is capable of swivelling. All parts of the nozzle systems can thus be exchanged, but are nevertheless fixed precisely in their position.

The replaceability of all parts of the nozzle system opens the possibility of modular construction of the fiber sliver guiding system between the output of the delivery rollers and the depositing of the calendared fiber sliver. Adjustments or settings with adaptation to given calendar disk width or for certain fiber types or processing conditions are no longer required. If processing conditions are stipulated, modular nozzles for these are provided, and are connected to each other via their respective inserts. The inserts fit any of the modular nozzles and establish the connection between the different technological parts. The replaceability also makes it possible to operate changes following a batch change.

The insert 40 was described through FIGS. 4*a*, 4*b*. It is plugged in opposition to the direction of fiber sliver movement into the fleece funnel 50. Its forward end is the articulation surface 41*a*, 41*b* which is attached to a cylindrical channel section 41. It has a constant curve which is oriented backwards on both sides of the central plane of the insert 40 while its width decreases symmetrically on both sides. The reduction of the width is at a right angle to the axial direction of the guiding channel 200*a*. The greatest width of the articulation surface is on the front end.

The channel segment 41 on which the articulation surface 41*a*, 41*b* is installed is made in one piece on a conical section 43 which merges into a cylindrical area 45 which has a slightly larger diameter than the also cylindrical plug-in section 42. Thus the cylindrical section 45 is able to function as a stop when the plug-in section 42 is plugged into the fleece funnel 50 from behind (contrary to the direction of movement of the fiber sliver).

The internal insert 30 for the sliver funnel holder 60 is shown in FIGS. 5*a* to 5*d*. It has the receiving bearing surface 35 in addition to the articulation surface 41*a*, 41*b* of the previously described insert. The bearing surfaces 35 also become narrower in the direction of axis 200*a* of the conveying path. The smallest width of the bearing surface 35 is at the forward intake end of the insert 30.

The outside dimensions of the insert 30 are sized so that it can be inserted into the sliver funnel holder 60. The holder 60 is made in one piece and is explained in further detail through FIGS. 6*a* to 6*c* in three different views. It is visibly larger than the actual sliver funnel which is constituted by insert 30 in this embodiment.

Figure 9A:
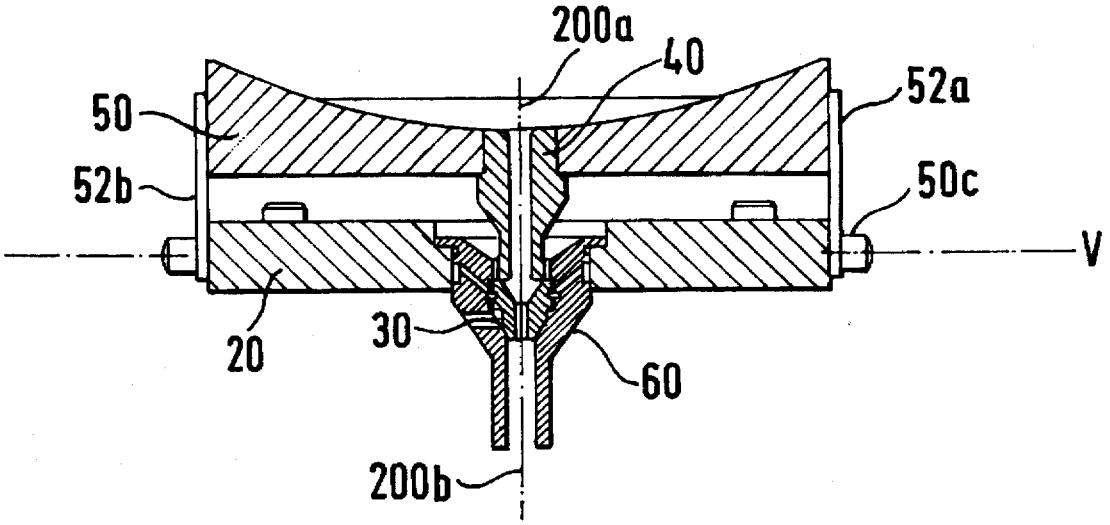
FIGS. 9a and 9b show the fleece funnel 50 with the tilting articulation 50c on the stationary holder 20 in which the sliver funnel 60, 30 is held and is detachable. The forward end 41 of the upper insert 40 is able to swivel and is supported in the lower insert 30 of the sliver funnel 60, for which two articulation surfaces 41a, 41b and 35 are used which interact radially to seal off air in operational position.
Figure 9B:
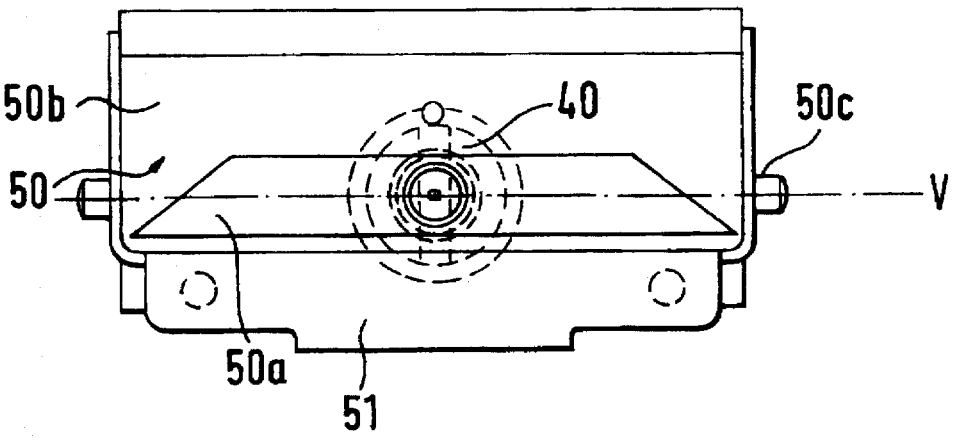

The holder 60 is installed fixedly relative to the calendar disks, and it is fitted out with injection nozzles 64*a*, 64*b* in order to feed air into the fiber sliver guiding system in the direction of travel. The fixed installation of the holder facilitates air feeding since it need not also be swivelled. FIGS. 9*a*, 9*b* show the fixedly installed holder 20 into which the sliver funnel holder 60 is introduced in a conical plug-in section, so that it is fixed precisely across from the calendar disks.

The beak halves 61*a*, 61*b* extending over the calendar disks are semi-circular in this embodiment. They are made in one piece with a cone 68 to which they are attached, and which is also on one piece with the cylindrical section 67 of the holder 60 into which it merges.

A cylindrical opening 62 into which any desired sliver funnel insert 30 can be inserted is provided in the cylindrical section 67. The outside dimensions of each sliver funnel 30 to be used is adapted to the inside dimensions of the holder 60. Even if different technological requirements apply which prescribe the sliver funnel in a form of channel 32*a*, 32, 31, the same sliver funnel holder 60 can be used.

Flow-through openings 64*a*, 64*b* by means of which air can be fed in proximity of the calendar disks in proximity of the calendar disks are provided in the cylindrical section 67 of the holder 60. This air is conveyed through the semi-circular beaks 61 in such a manner that it is at least prevented from escaping before the calendar nip 100*c* (or 100*d* according to FIG. 7*b*). Widening areas 65*a*, 65*b* are provided for this, leading past the calendar nip 100*c* according to FIG. 7. Their size by comparison with the width of the calendar disks or with the width b of the semicircular beaks can clearly be seen from FIGS. 7*a* or 7*b*. They are determined by the compression effect of the cover surface d which defines the inner sealing side of the semi-circular beaks against the calendar disks by means of flow resistance, whereby a contact-less seal is achieved through markedly greater flow resistance in perpendicular direction than the low flow resistance in axial direction which is defined by the size of the widening area.

Figure 8B:
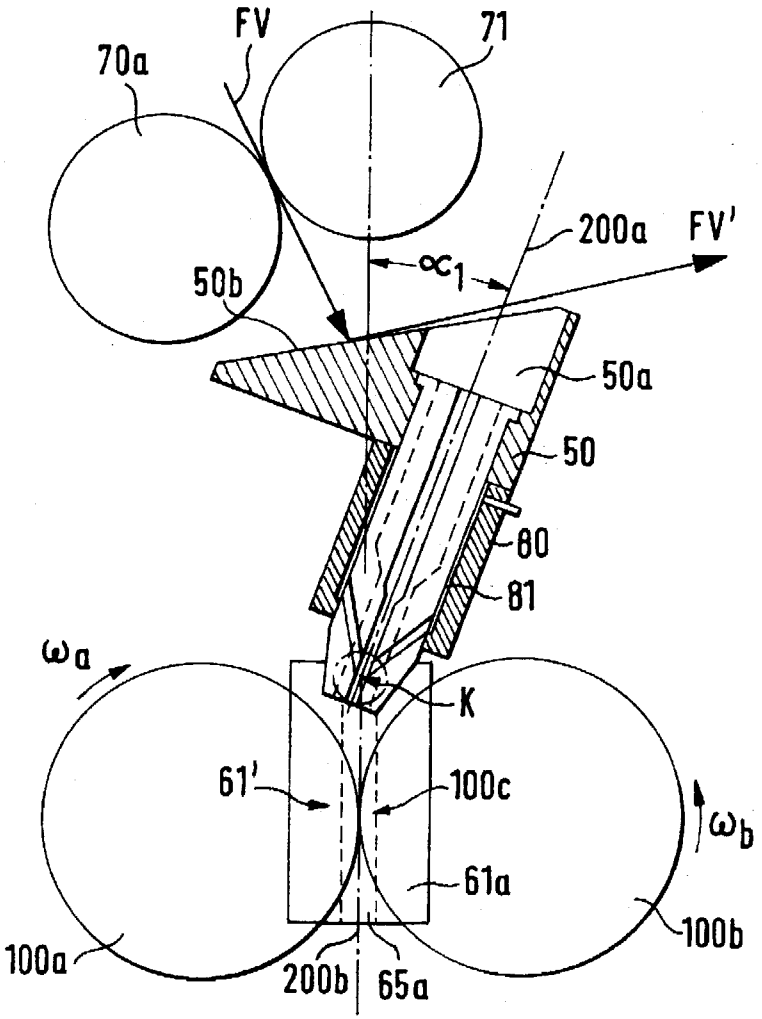
FIGS. 8a and 8b show an embodiment comparable to that of FIGS. 3a, 3b, in which the swivelling area has at the same time a bend K in the guidance axis 200a, 200b of the fiber sliver guidance. A calendar guidance section (61') remains under the axial bend K as a fixed section 61'. All the nozzle function elements—also the sliver funnel area—between delivery rollers 71, 70a, 70b and calendar disks 100a, 100b are able to swivel. The area above section 61' is made in one part as insert 40, 30 into the fleece funnel 50, surrounded by a cylindrical holder 80.
Figure 8A:
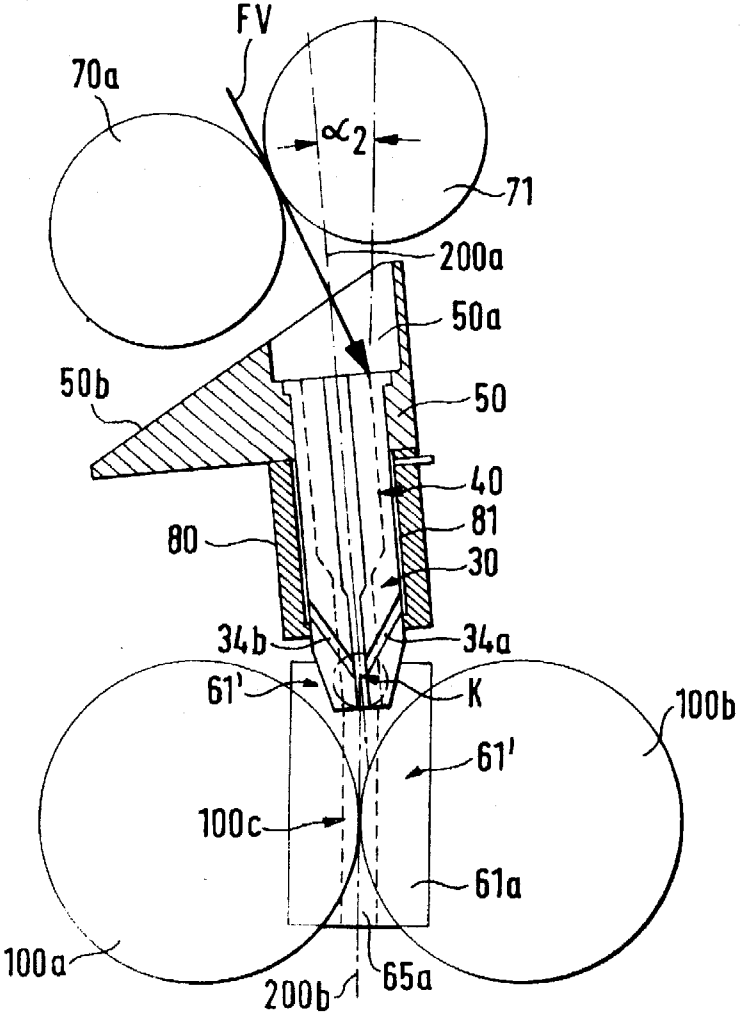

FIGS. 8*a* and 8*b* show the configuration of a guiding section made essentially in one piece and containing the fleece nozzle 50 as well as the sliver funnel 30. The sliver funnel 30 is here inserted directly into the fleece funnel 50 and its position is furthermore fixed by a pipe holder 80. The forward end of the sliver funnel 30 is supported in comparable bearing cups and rounding surfaces as described through FIGS. 4*b* and 5*c* in connection with the fleece funnel insert 40.

The radial seal is achieved thus also in FIGS. 8*a* and 8*b*, where a remaining section 61' of the guiding section is fixedly held relative to the calendar disks, e.g. on holder 20 according to FIG. 9*a*. The remaining guiding section 61' corresponds to the beak area L of the sliver funnel holder 60 of FIG. 6*a*. In this embodiment the air is introduced via slanted injection bores 34*a*, 34*b* into the combined fleece funnel/sliver funnel at its forward end, whereby a swivelling motion provokes a slight swivelling of the location of air introduction which is however minimal because of its proximity to the pivot point K.

Figure 3B:
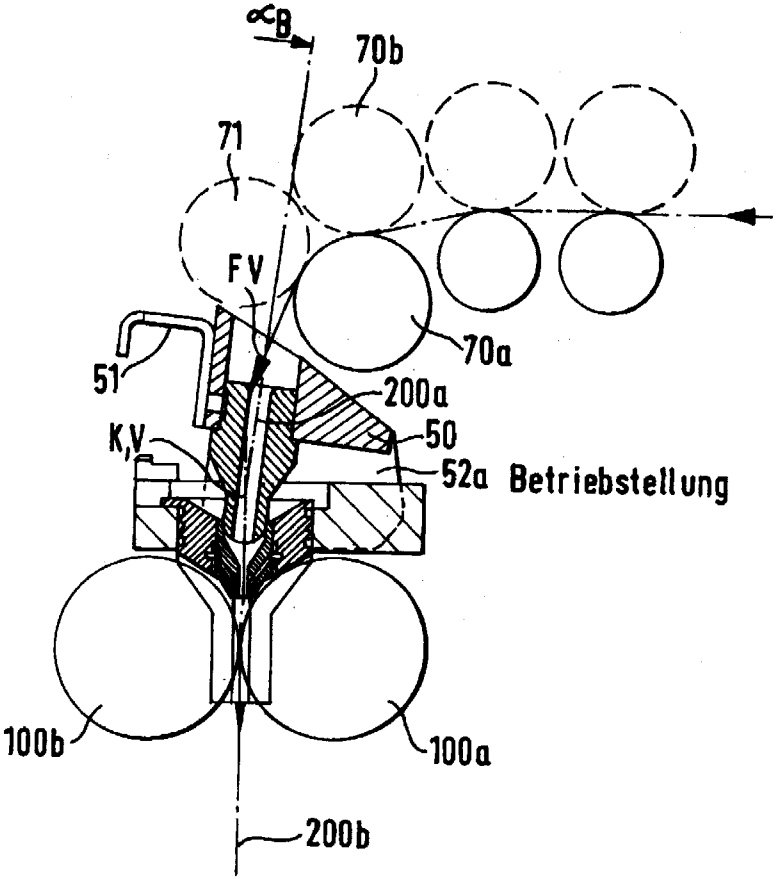
FIGS. 3*a* and 3*b* show the two tilting positions relative to the fiber sliver introduction and in operation of the draw frame.
Figure 3A:
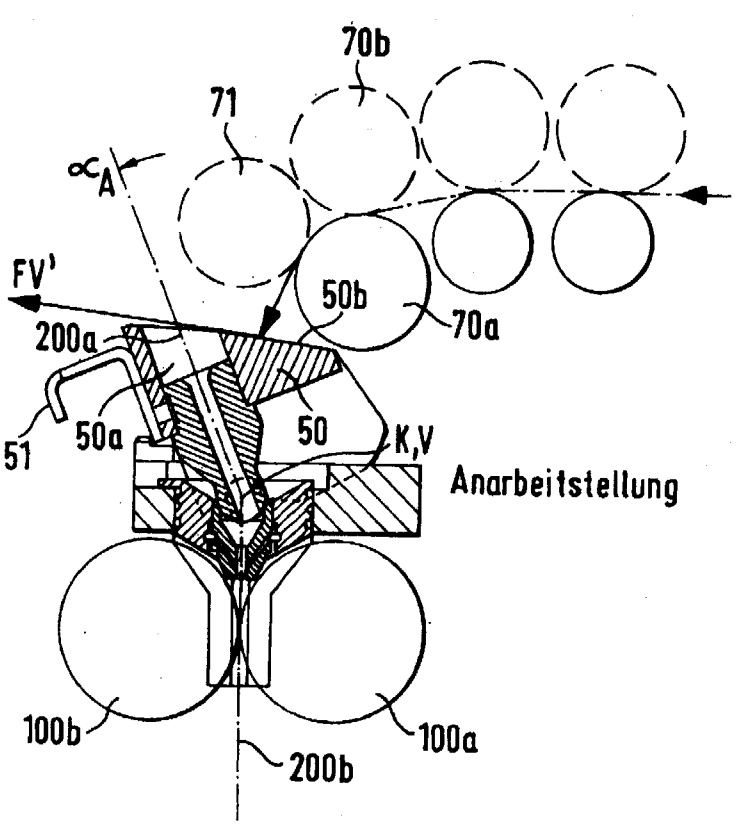

The two swivel positions shown in FIGS. 8*a* and 8*b* are designated $\alpha_A$ and $\alpha_B$, but may be of slightly different size, since the swivelling part in FIGS. 8*a* and 8*b* is larger or longer than in FIGS. 3*a* and 3*b*.

Different bores and corresponding conical transition sections in the insert 40 which is at the same time fleece funnel insert and sliver funnel 30 define the fiber sliver guiding sections. Replacement of the insert 40 represents at the same time a replacement of the sliver funnel 30. Readjustments or alignment tasks can be omitted because of the one-piece configuration.

The ring-shaped holder 80 is not entirely flush with the combined fleece funnel/sliver funnel, but leaves a ring space 81 between the inside of the funnel and the outer diameter of the mostly cylindrical combination funnel 30/40. The ring space 81 guides the compressed air used for fiber conveying, and is sealed at the forward end by flush (ring-shaped) contact against the combination nozzle, below the injection bores 34*a*, 34*b*. At a suitable height selected as a function of the application, a main air stream is conveyed outwardly and lets out in the ring space, being able to build up compressed air at that location in order to feed the injection bores 34*a*, 34*b*.

The injection bores are clearly at an angle in this example relative to the axis 200*b*, and stop directly in front of the radially air-tight articulation K where a radial, air-tight support is provided in the two positions of FIGS. 8 and 8*b*.

The angles $\alpha_1$ and $\alpha_2$ are slightly smaller than in the example of FIGS. 2*a* and 2*b*, but are within the same indicated range as in FIG. 2. The precise angle in this embodiment is approximately 5° for $\alpha_2$, for $\alpha_1$ approximately 25° (±10%), while in FIG. 2*a* an angle of $\alpha_A$ of approximately 30° and in FIG. 2*b* an angle of approximately 7° (±10%) have worked reliably in the experiment.

The plateau area 50*b* in FIGS. 8*a* and 8*b* is accordingly somewhat adapted relative to the angle of the ramp area 50*b* in FIGS. 2*a* and 7*b*. It is connected to the angles $\alpha$ in the respective final swivel positions, whereby the swivel position $\alpha_1$ and $\alpha_A$ require an angle of the ramp such that the direction of movement of the fiber fleece FV is clearly perpendicular coming out of the output area of the draw frame. Here it is advantageous if the perpendicular direction FV' contains a slight downward component, e.g. if it is slightly at a downward angle from the horizontal.

The ramp area is given a slight slope of 1° to 2° for that purpose from the funnel area, or is slightly conical.

Two different fiber sliver channel sizes are shown in the combination funnel 30/40 in FIGS. 8*a* and 8*b*, one narrow and one wide, each with a conical shoulder towards the narrowest cylindrical section of the fiber sliver channel.

FIGS. 9*a* and 9*b* show a side view and top view of the fleece funnel 50 with its ramp area 50*b* and its funnel area 50*a* according to FIG. 3. The swivel axis V is perpendicular to the guide axis 200*a*, 200*b* and extends through the air-tight articulation 41*a*, 41*b* and 35, as shown in FIGS. 4 and 5. At the same time the swivel axis V extends through bearings 50*c* which are constituted by lateral holding brackets 52*a*, 52*b* and journals which can be set on the forward, half open swivel seat. The fleece funnel 50 can thus be removed and tilted, while the guiding channel 200*a*, 200*b* is at the same time air-tight.

It will be apparent to those skilled in the art that various modifications and variations can be made in the present invention without departing from the scope and spirit of the invention. It is intended that the present invention cover such modifications and variations as come within the scope of the appended claims and their equivalents.

We claim:

1. A fiber sliver guidance system for a textile machine drafting equipment wherein a fiber sliver is drafted by pairs of drafting rollers and conveyed by a pair of delivery rollers to calendar rollers, said guidance system operably disposed between said delivery rollers and said calendar rollers and comprising:

a first nozzle section disposed relative to said delivery rollers so as to receive a fiber fleece therefrom and form said fleece into a fiber sliver;

a second nozzle section articulatably connected to said first nozzle section in an essentially airtight manner so as to receive said fiber sliver therefrom, said second nozzle section comprising an essentially cylindrical sliver channel disposed to guide said sliver to a nip defined by said calendar rollers; and said sliver channel of said second nozzle section further comprising a guiding section defined by spaced apart end segments which extend on opposite sides of and alongside said calendar rollers past said nip, said side segments cooperating with said calendar rollers to define a limited air loss channel for said fiber sliver directly to said nip.

2. The system as in claim 1, wherein said second nozzle section comprises a funnel section merging into said sliver channel.

3. The system as in claim 2, wherein said second nozzle section is articulatably connected to said first nozzle section in an essentially air tight configuration.

4. The system as in claim 2, wherein said guiding section is articulatably connected to said second nozzle section in an essentially air tight configuration.

5. The system as in claim 1, further comprising at least two air injection bores defined in said sliver channel, said bores angled relative to a longitudinal axis of said sliver channel so as to introduce pressurized air into said sliver channel in a direction towards said calendar rollers.

6. The system as in claim 1, wherein said second nozzle section comprises a second nozzle insert removably seated in a nozzle holder.

7. The system as in claim 6, wherein said first nozzle section comprises a first nozzle insert removably seated in a funnel section of said first nozzle section, said first nozzle insert having a forward end articulatably connected to said second nozzle insert.

8. The system as in claim 1, wherein said first and second nozzle sections comprise a respective nozzle insert.

9. The system as in claim 8, wherein said nozzle inserts are connected as an integral component.

10. The system as in claim 9, wherein said nozzle inserts are articulatably connected.

11. A nozzle insert for removable configuration with a fleece guiding system, said nozzle insert comprising an internal guiding channel having a substantially constant diameter; a substantially cylindrical plug-in section surrounding a first end of said channel, said plug-in section configured for interlocking engagement with a nozzle insert holder of said fleece guiding system; a conical section adjacent said plug-in section; a substantially cylindrical channel section adjacent said conical section opposite said plug-in section; and said channel section further comprising a substantially rounded articulation surface defined on an end thereof opposite said conical section so that said nozzle insert can articulate an essentially airtight connection in said fleece guiding system.

12. A nozzle insert for removable configuration in a holder of a fiber sliver funnel guiding system, said nozzle insert comprising a substantially cylindrical channel at a downstream end thereof in a direction of conveyance of fiber sliver therethrough; a conical section adjacent said cylindrical channel having a substantially rounded articulation surface defined on one end thereof so that a fiber fleece nozzle can be articulatably connected thereto; and a plurality of air injection bores defined into said cylindrical channel and aligned at an angle relative to a longitudinal axis through said channel so as to direct pressurized air into said channel towards said downstream end thereof.

13. A fiber sliver funnel for introducing a sliver to the nip of a pair of calendar rollers, said fiber funnel is part of a sliver guidance system wherein said funnel comprises a guiding section defining a channel therethrough, said guiding section comprising spaced apart end segments having a length so as to extend on opposite sides of and alongside calendar rollers past the nip thereof, said side segments having a cross section so as to form a limited air loss channel with said calendar rollers to prevent air which conveys the sliver from escaping said channel at least before said nip in a conveying direction of sliver through said guiding section.

* * * * *